US009518315B2

(12) United States Patent
Wetzel et al.

(10) Patent No.: US 9,518,315 B2
(45) Date of Patent: Dec. 13, 2016

(54) PROCESSES FOR IMPROVING FORMABILITY OF WROUGHT COPPER-NICKEL-TIN ALLOYS

(71) Applicant: Materion Corporation, Mayfield Heights, OH (US)

(72) Inventors: John F. Wetzel, Hamburg, PA (US); Ted Skoraszewski, New Ringold, PA (US)

(73) Assignee: Materion Corporation, Mayfield Heights, OH (US)

( * ) Notice: Subject to any disclaimer, the term of this patent is extended or adjusted under 35 U.S.C. 154(b) by 182 days.

(21) Appl. No.: 14/204,489

(22) Filed: Mar. 11, 2014

(65) Prior Publication Data

US 2014/0261924 A1 Sep. 18, 2014

Related U.S. Application Data

(60) Provisional application No. 61/782,802, filed on Mar. 14, 2013.

(51) Int. Cl.

| | |
|---|---|
| ***C22F 1/08*** | (2006.01) |
| ***C22F 1/10*** | (2006.01) |
| ***C22C 9/06*** | (2006.01) |

(52) U.S. Cl.

CPC . *C22F 1/08* (2013.01); *C22C 9/06* (2013.01); *C22F 1/10* (2013.01)

(58) Field of Classification Search

CPC ..... C22F 1/08

See application file for complete search history.

(56) References Cited

U.S. PATENT DOCUMENTS

| | | | |
|---|---|---|---|
| 4,142,918 | A | 3/1979 | Plewes |
| 4,373,970 | A | 2/1983 | Scorey et al. |
| 4,681,629 | A | 7/1987 | Reinshagen |
| 5,198,044 | A | 3/1993 | Colijn et al. |
| 5,486,244 | A | 1/1996 | Caron et al. |
| 6,251,199 | B1 | 6/2001 | Mandigo et al. |

OTHER PUBLICATIONS

International Search Report for PCT/US14/23442 dated Jun. 5, 2014.

*Primary Examiner* — Veronica F Faison

(74) *Attorney, Agent, or Firm* — Richard M. Klein; Fay Sharpe LLP

(57) ABSTRACT

Disclosed are processes for improving the formability of a copper-nickel-tin alloy having a 0.2% offset yield strength that is above 115 ksi. The alloy includes about 14.5 to about 15.5 wt % nickel, about 7.5 to about 8.5 wt % tin, and the remaining balance is copper. The copper-nickel-tin alloy is mechanically cold worked to undergo between 5% and 15% plastic deformation. The alloy is then heat treated at elevated temperatures of about 450° F. to about 550° F. for a period of about 3 hours to about 5 hours. The alloy is then subsequently mechanically cold worked again to undergo between 4% and 12% plastic deformation. The alloy is then further heated to an elevated temperature of about 700° F. to about 850° F. for a period between about 3 minutes and about 12 minutes to relieve stress. The resulting alloy has a combination of good formability ratio and good yield strength.

20 Claims, 4 Drawing Sheets

PROCESSES FOR IMPROVING FORMABILITY OF WROUGHT COPPER-NICKEL-TIN ALLOYS

CROSS-REFERENCE TO RELATED APPLICATIONS

This application claims priority to U.S. Provisional Patent Application Ser. No. 61/782,802, filed on Mar. 14, 2013, the contents of which are fully incorporated by reference herein.

BACKGROUND

The present disclosure relates to processes for enhancing the formability characteristics of a copper-nickel-tin alloy while maintaining substantially equal strength levels when compared to known copper-nickel-tin alloys.

Copper-beryllium alloys are used in various industrial and commercial applications that require the alloy to be fitted within confined spaces and also have reduced size, weight and power consumption features, to increase the efficiency and functionality of the application. Copper-beryllium alloys are utilized in these applications due to their high strength, resilience and fatigue strength.

Some copper-nickel-tin alloys have been identified as having desirable properties similar to those of copper-beryllium alloys, and can be manufactured at a reduced cost. For example, a copper-nickel-tin alloy offered as Brush-form® 158 (BF 158) by Materion Corporation, is sold in various forms and is a high-performance, heat treated alloy that allows a designer to form the alloy into electronic connectors, switches, sensors, springs and the like. These alloys are generally sold as a wrought alloy product in which a designer manipulates the alloy into a final shape through working rather than by casting. However, these copper-nickel-tin alloys have formability limitations compared to copper-beryllium alloys.

It would be desirable to develop new processes for using copper-nickel-tin alloys that would improve the formability characteristics of the alloy.

BRIEF DESCRIPTION

The present disclosure relates to processes for improving the formability (i.e. capacity of a material to be shaped by plastic deformation) of a cast copper-nickel-tin alloy. Generally, the alloy is first mechanically cold worked to undergo a plastic deformation % CW (i.e. percentage cold working) of about 5% to about 15%. The alloy then undergoes a thermal stress relief step by heating to an elevated temperature between about 700° F. and about 950° F. for a period of between about 3 minutes and about 12 minutes to produce the desired formability characteristics.

Disclosed in specific embodiments are processes that improve the formability of a copper-nickel-tin alloy to produce an alloy composition having a yield strength that is at least 115 ksi. The alloy includes from about 14.5 wt % to about 15.5 wt % nickel, from about 7.5 wt % to about 8.5 wt % tin, and the remaining balance is copper. The processing steps include cold working the copper-nickel-tin alloy wherein the alloy undergoes between about 5% and about 15% plastic deformation. Next, the alloy is heat treated at elevated temperatures between about 450° F. and about 550° F. for a period of between about 3 hours and about 5 hours. The alloy is then cold worked wherein the alloy undergoes between about 4% and about 12% plastic deformation. The alloy then subsequently undergoes a thermal stress relief step by heating to an elevated temperature between about 700° F. and about 850° F. for a period of between about 3 minutes and about 12 minutes to produce the desired formability and yield strength characteristics.

Also disclosed are processes for improving the formability of a cast copper-nickel-tin alloy to produce an alloy composition having a yield strength that is at least 130 ksi. The alloy includes about 14.5 wt % to about 15.5 wt % nickel, about 7.5 wt % to about 8.5 wt % tin, and the remaining balance is copper. The steps include cold working the copper-nickel-tin alloy wherein the alloy undergoes from about 5% to about 15% plastic deformation. The alloy is then heat treated at elevated temperatures from about 775° F. to about 950° F. for a period of from about 3 minutes to about 12 minutes to produce the desired formability and yield strength characteristics. The resulting alloy has a yield strength of at least 130 ksi and a formability ratio of below 2 in the transverse direction and below 2.5 in the longitudinal direction.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
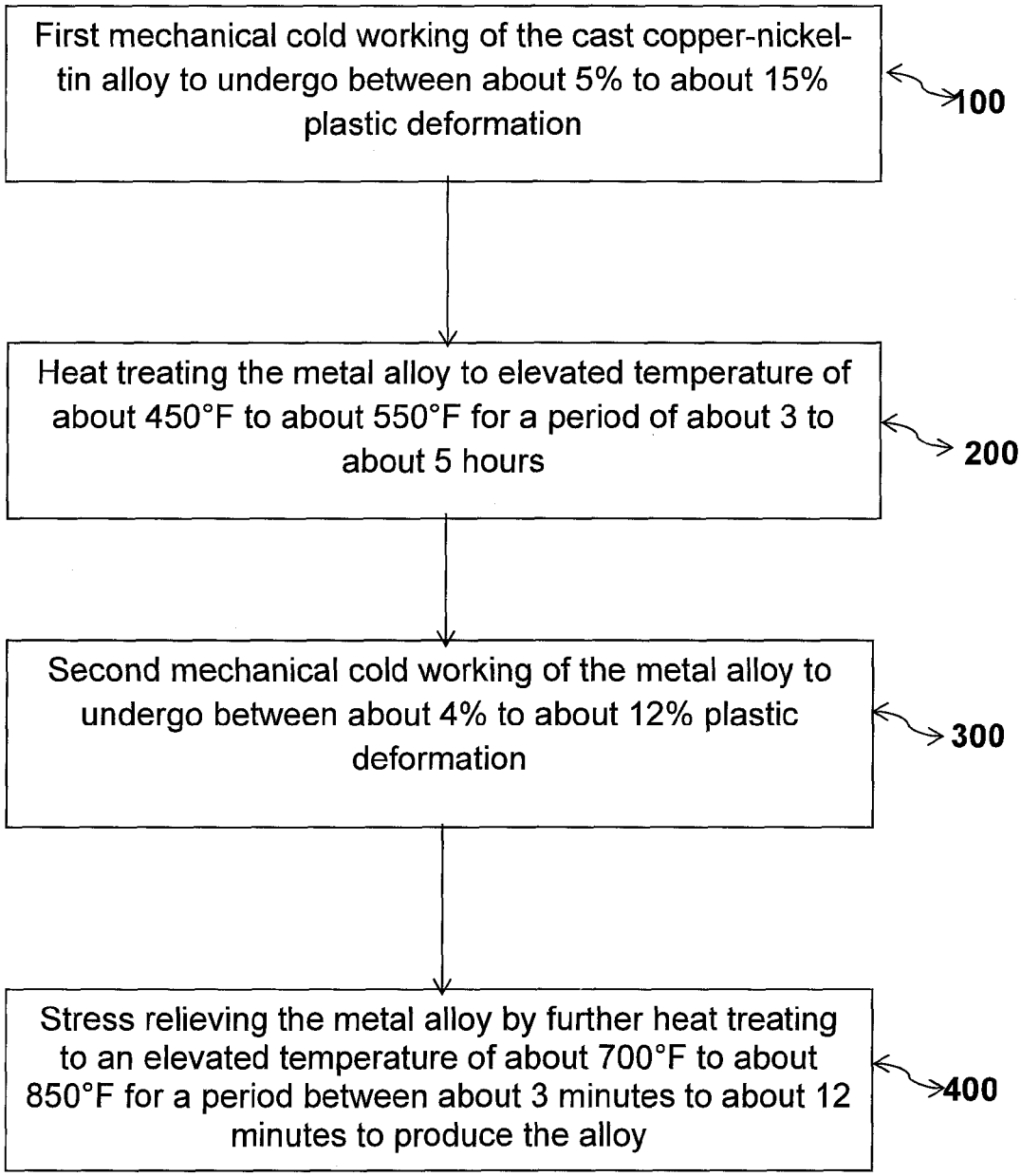
FIG. 1 is a flow chart illustrating an exemplary process of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

Percentages of elements should be assumed to be percent by weight of the stated alloy, unless expressly stated otherwise.

As used herein, the term "spinodal alloy" refers to an alloy whose chemical composition is such that it is capable of undergoing spinodal decomposition. The term "spinodal alloy" refers to alloy chemistry, not physical state. Therefore, a "spinodal alloy" may or may not have undergone spinodal decomposition and may or not be in the process of undergoing spinodal decomposition.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

The copper-nickel-tin alloy utilized herein generally includes from about 9.0 wt % to about 15.5 wt % nickel, and from about 6.0 wt % to about 9.0 wt % tin, with the remaining balance being copper. This alloy can be hardened and more easily formed into high yield strength products that can be used in various industrial and commercial applications. This high performance alloy is designed to provide properties similar to copper-beryllium alloys.

More particularly, the copper-nickel-tin alloys of the present disclosure include from about 9 wt % to about 15 wt % nickel and from about 6 wt % to about 9 wt % tin, with the remaining balance being copper. In more specific embodiments, the copper-nickel-tin alloys include from about 14.5 wt % to about 15.5% nickel, and from about 7.5 wt % to about 8.5 wt % tin, with the remaining balance being copper. These alloys can have a combination of various properties that separate the alloys into different ranges. More specifically, "TM04" refers to copper-nickel-tin alloys that generally have a 0.2% offset yield strength of 105 ksi to 125 ksi, an ultimate tensile strength of 115 ksi to 135 ksi, and a Vickers Pyramid Number (HV) of 245 to 345. To be considered a TM04 alloy, the yield strength of the alloy must be a minimum of 115 ksi. "TM06" refers to copper-nickel-tin alloys that generally have a 0.2% offset yield strength of 120 ksi to 145 ksi, an ultimate tensile strength of 130 ksi to 150 ksi, and a Vickers Pyramid Number (HV) of 270 to 370. To be considered a TM06 alloy, the yield strength of the alloy must be a minimum of 130 ksi.

FIG. 1 illustrates a flowchart for a TM04 rated copper-nickel-tin alloy that outlines the steps of the metal working processes of the present disclosure. It is particularly contemplated that these processes are applied to such TM04 rated alloys. The process begins by first cold working the alloy 100.

Cold working is the process of mechanically altering the shape or size of the metal by plastic deformation. This can be done by rolling, drawing, pressing, spinning, extruding or heading of the metal or alloy. When a metal is plastically deformed, dislocations of atoms occur within the material. Particularly, the dislocations occur across or within the grains of the metal. The dislocations over-lap each other and the dislocation density within the material increases. The increase in over-lapping dislocations makes the movement of further dislocations more difficult. This increases the hardness and tensile strength of the resulting alloy while generally reducing the ductility and impact characteristics of the alloy. Cold working also improves the surface finish of the alloy. Mechanical cold working is generally performed at a temperature below the recrystallization point of the alloy, and is usually done at room temperature. The percentage of cold working (% CW), or the degree of deformation, can be determined by measuring the change in the cross-sectional area of the alloy before and after cold working, according to the following formula:

$$\% CW = 100*[A_0 - A_f]/A_0$$

where $A_0$ is the initial or original cross-sectional area before cold working, and $A_f$ is the final cross-sectional area after cold working. It is noted that the change in cross-sectional area is usually due solely to changes in the thickness of the alloy, so the % CW can also be calculated using the initial and final thickness as well.

In embodiments, the initial cold working 100 is performed so that the resulting alloy has a % CW in the range of about 5% to about 15%. More particularly, the % CW of this first step can be about 10%.

Next, the alloy undergoes a heat treatment 200. Heat treating of metal or alloys is a controlled process of heating and cooling metals to alter their physical and mechanical properties without changing the product shape. Heat treatment is associated with increasing the strength of the material, but it can also be used to alter certain manufacturability objectives such as to improve machining, improve formability, or to restore ductility after a cold working operation. The initial heat treating step 200 is performed on the alloy after the initial cold working step 100. The alloy is placed in a traditional furnace or other similar assembly and then exposed to an elevated temperature in the range of about 450° F. to about 550° F. for a time period of from about 3 hours to about 5 hours. In more specific embodiments, the alloy is exposed to an elevated temperature of about 525° F. for a duration of about 4 hours. It is noted that these temperatures refer to the temperature of the atmosphere to which the alloy is exposed, or to which the furnace is set; the alloy itself does not necessarily reach these temperatures.

After the heat treatment step 200, the resulting alloy material undergoes a second cold working or planish step 300. More particularly, the alloy is mechanically cold worked again to obtain a % CW in the range of about 4% to about 12%. More particularly, the % CW of this first step can be about 8%. It is noted that the "initial" cross-sectional area or thickness used to determine the % CW is measured after the heat treatment and before this second cold working begins. Put another way, the initial cross-sectional area/thickness used to determine this second % CW is not the original area/thickness before the first cold working step 100.

The alloy then undergoes a thermal stress relieving treatment to achieve the desired formability properties 400 after the second cold working step 300. In embodiments, the alloy is exposed to an elevated temperature in the range of from about 700° F. to about 850° F. for a time period of from about 3 minutes to about 12 minutes. More particularly, the elevated temperature is about 750° F. and the time period is about 11 minutes. Again, these temperatures refer to the temperature of the atmosphere to which the alloy is exposed, or to which the furnace is set; the alloy itself does not necessarily reach these temperatures.

After undergoing the process described above, the TM04 copper-nickel-tin alloy will exhibit a formability ratio that is below 1 in the transverse direction and a formability ratio that is below 1 in the longitudinal direction. The formability ratio is usually measured by the R/t ratio. This specifies the minimum inside radius of curvature (R) that is needed to form a 90° bend in a strip of thickness (t) without failure, i.e. the formability ratio is equal to R/t. Materials with good formability have a low formability ratio (i.e. low R/t). The formability ratio can be measured using the 90° V-block test, wherein a punch with a given radii of curvature is used to force a test strip into a 90° die, and then the outer radius of the bend is inspected for cracks. In addition, the alloy will have a 0.2% offset yield strength of at least 115 ksi.

The longitudinal direction and the transverse direction can be defined in terms of a roll of the metal material. When a strip is unrolled, the longitudinal direction corresponds to the direction in which the strip is unrolled, or put another way is along the length of the strip. The transverse direction corresponds to the width of the strip, or the axis around which the strip is unrolled.

Figure 3:
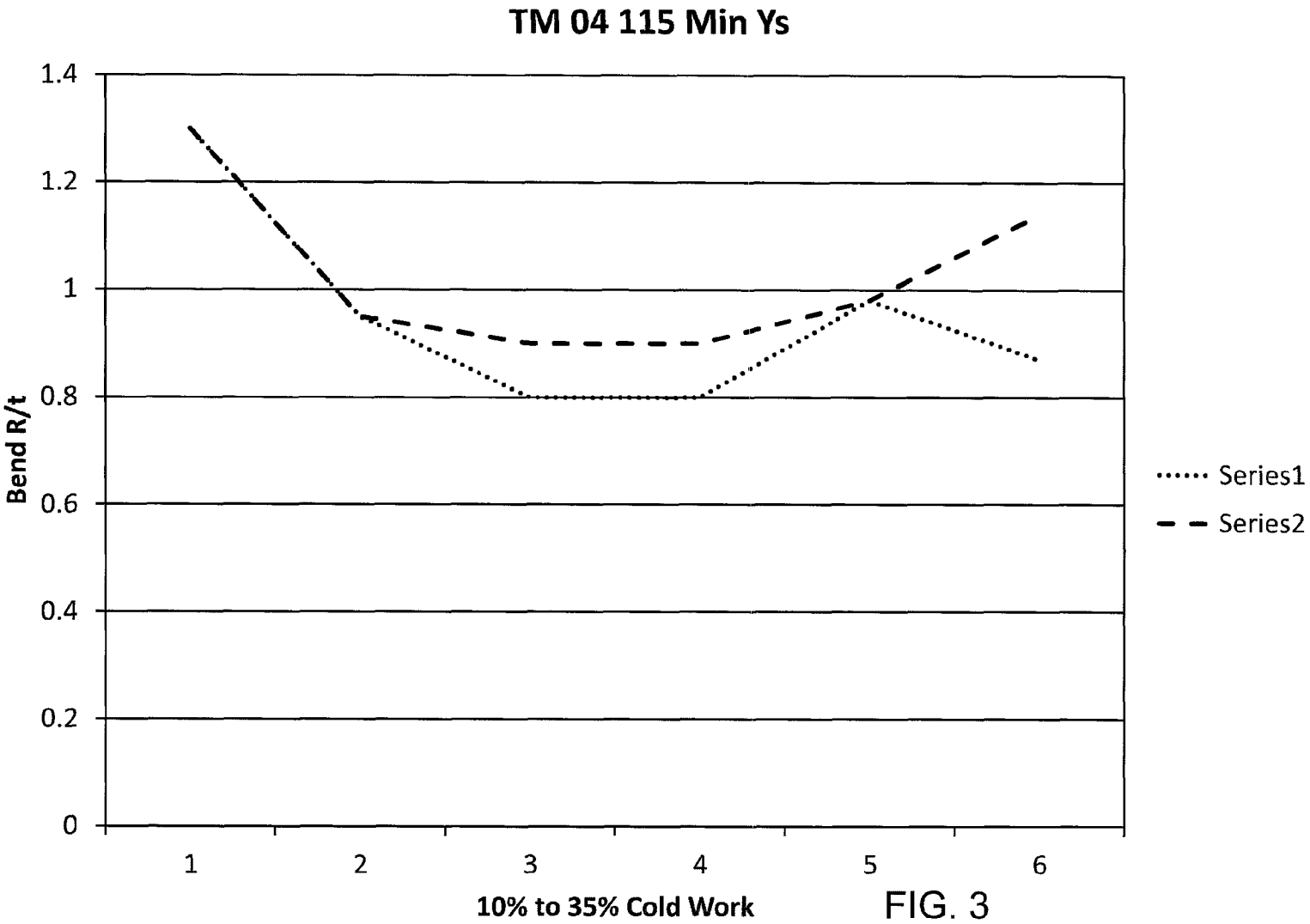
FIG. 3 is a line graph illustrating experimental data indicating the formability ratio (R/t) yield strength for alloys of the present disclosure having a minimum 0.2% offset yield strength of 115 ksi, after various percentages of cold working, in both the longitudinal direction and the transverse direction.

FIG. 3 is a line graph of experimental data indicating the formability ratio (R/t) of a TM04 copper-nickel-tin alloy having a minimum yield strength of 115 Ksi. The y-axis is the R/t ratio, and the x-axis is the percentage of cold working (% CW). The line graph is taken from six (6) experimental tests performed on a TM04 rated alloy, measured at CW % of 10%, 15%, 20%, 25%, 30%, and 35% (numbered 1 through 6, respectively) to obtain the curves. These were measured prior to heat treatment. Series 1 (dots) represents the formability ratio in the transverse direction, and Series 2 (dashes) represents the formability ratio in the longitudinal direction. As seen here, formability ratios below 1 can be obtained after % CW between 10% and 30%.

Figure 2:
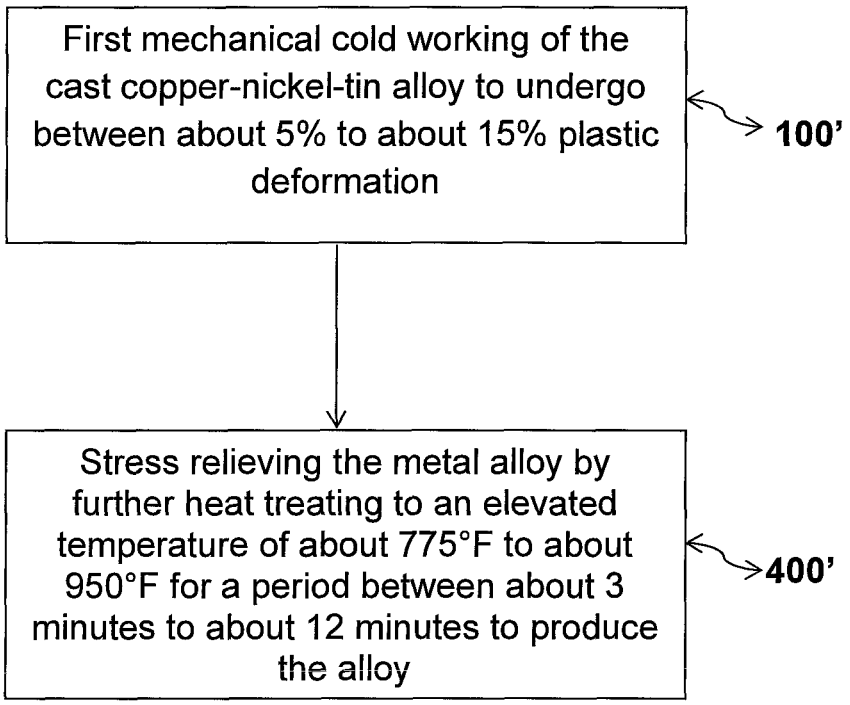
FIG. 2 is a flow chart illustrating a further exemplary process of the present disclosure.

FIG. 2 illustrates a flowchart for a TM06 rated copper-nickel-tin alloy that outlines the steps of the metal working processes of the present disclosure. It is particularly contemplated that these processes are applied to such TM06 rated alloys. The process begins by first cold working the alloy 100'. In this embodiment, the initial cold working step 100' is performed so that the resulting alloy has a % CW in the range of about 5% to about 15%. More particularly, the % CW is about 10%.

Next, the alloy then undergoes a heat treatment 400'. This is similar to the thermal stress relief step applied to the TM04 alloy at 400'. In embodiments, the alloy is exposed to an elevated temperature in the range of from about 775° F. to about 950° F. for a time period of from about 3 minutes to about 12 minutes. More particularly, the elevated temperature is about 850° F.

Compared to the metal process for the TM04 rated tempered alloy, the resulting TM06 alloy material does not undergo a heat treatment step (i.e. 200 in FIG. 1) or a second cold working process/planish step (i.e. 300 in FIG. 1).

After undergoing the process described above, the TM06 copper-nickel-tin alloy will exhibit a formability ratio that is below 2 in the transverse direction and a formability ratio that is below 2.5 in the longitudinal direction. In more specific embodiments, the TM06 copper-nickel-tin alloy will exhibit a formability ratio that is below 1.5 in the transverse direction and a formability ratio that is below 2 in the longitudinal direction. Additionally, the copper-nickel-tin alloy will have a yield strength of at least 130 ksi, and more desirably a yield strength of at least 135 ksi.

Figure 4:
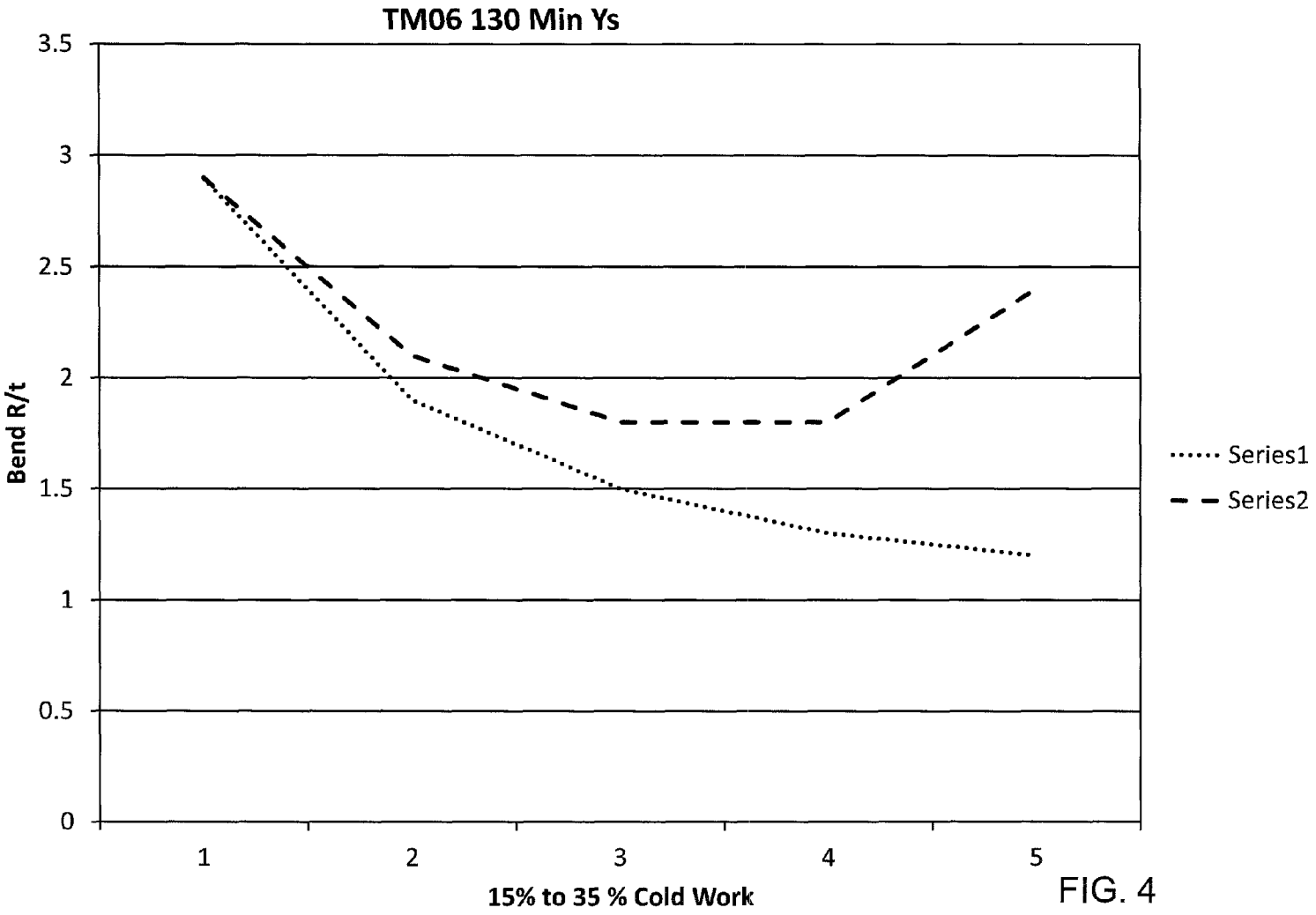
FIG. 4 is a line graph illustrating experimental data indicating the formability ratio (R/t) for alloys of the present disclosure having a minimum 0.2% offset yield strength of 130 ksi, after various percentages of cold working, in both the longitudinal direction and the transverse direction.

FIG. 4 is a line graph of experimental data indicating the formability ratio (R/t) of a TM06 copper-nickel-tin alloy having a minimum yield strength of 130 Ksi. The y-axis is the R/t ratio, and the x-axis is the percentage of cold working (% CW). The line graph is taken from five (5) experimental tests performed on a TM06 rated alloy, measured at CW % of 15%, 20%, 25%, 30%, and 35% (numbered 1 through 5, respectively) to obtain the curves. These were measured prior to heat treatment. Series 1 (dots) represents the formability ratio in the transverse direction, and Series 2 (dashes) represents the formability ratio in the longitudinal direction.

A formability ratio that is below 2 in the transverse direction and a formability ratio that is below 2.5 in the longitudinal direction can be obtained at % CW of 20% to 35%. A formability ratio that is below 1.5 in the transverse direction and a formability ratio that is below 2 in the longitudinal direction can be obtained at % CW of 25% to 30%.

A balance is reached between cold working and heat treating in the processes disclosed herein. There is an ideal balance between the amount of strength and the formability ratio that is gained from cold working and heat treatment.

The following examples are provided to illustrate the alloys, articles, and processes of the present disclosure. The examples are merely illustrative and are not intended to limit the disclosure to the materials, conditions, or process parameters set forth therein.

EXAMPLES

Copper-nickel-tin alloys containing 15 wt % nickel, 8 wt % tin, and balance copper were formed into strips having an initial thickness of 0.010 inches. The strips were then cold worked using a rolling assembly traveling at a rate of about 6 feet per minute (fpm). The strips were cold worked and measured at % CW of 5% (0.0095 inches), 10% (0.009 inches), 15% (0.0085 inches), and 20% (0.008 inches). Next, the strips underwent a thermal stress relief treatment at temperatures of 700° F., 750° F., 800° F., or 850° F.

After the thermal stress relief treatment, various properties were measured. Those properties included the tensile strength (T) in ksi; the yield strength (Y) in ksi; the % elongation at break (E); and the Young's modulus (M) in millions of psi. Table 1 provides the measured results.

TABLE 1

| Temp | T | Y | E | M |
|---|---|---|---|---|
| (1) Rolled 0.0085 to .008 | | | | |
| 700 | 137.4 | 123.5 | 16 | 19.5 |
| 700 | 138.8 | 124.9 | 16 | 20.2 |
| 750 | 156.1 | 140.2 | 15 | 21.0 |
| 750 | 156.5 | 140.9 | 15 | 19.7 |
| 800 | 168.2 | 153.3 | 10 | 21.1 |
| 800 | 169.6 | 156.6 | 9 | 20.2 |
| 850 | 172.1 | 161.8 | 7 | 19.9 |
| 850 | 172.3 | 159.6 | 8 | 22.2 |
| (2) Rolled 0.009 to 0.0085 | | | | |
| 700 | 129.1 | 108.6 | 16 | 20.2 |
| 700 | 128.5 | 107.7 | 17 | 21.1 |
| 750 | 147.3 | 127.2 | 16 | 21.6 |
| 750 | 146.9 | 124.6 | 17 | 21.4 |
| 800 | 162.5 | 142.3 | 14 | 20.7 |
| 800 | 162.6 | 143.0 | 13 | 20.9 |
| 850 | 169.1 | 156.1 | 10 | 20.5 |
| 850 | 168.9 | 156.3 | 9 | 20.5 |
| (3) Rolled 0.0095 to 0.009 | | | | |
| 700 | 123.8 | 101.0 | 21 | 20.9 |
| 700 | 123.1 | 102.2 | 14 | 20.7 |
| 750 | 142.1 | 117.9 | 19 | 20.7 |
| 750 | 146.4 | 122.4 | 18 | 21.0 |
| 800 | 158.7 | 135.2 | 17 | 20.3 |
| 800 | 160.4 | 140.6 | 12 | 20.3 |
| 850 | 167.3 | 152.0 | 10 | 19.8 |
| 850 | 167.8 | 153.4 | 10 | 19.8 |
| (4) Rolled 0.010 to 0.0095 | | | | |
| 700 | 112.2 | 80.6 | 24 | 20.2 |
| 700 | 112.3 | 80.5 | 30 | 20.7 |
| 750 | 133.9 | 102.2 | 20 | 20.5 |
| 750 | 134.6 | 106.0 | 18 | 20.1 |
| 800 | 152.5 | 121.4 | 17 | 20.1 |
| 800 | 154.4 | 123.6 | 17 | 20.1 |
| 850 | 160.6 | 139.4 | 12 | 19.8 |
| 850 | 162.1 | 140.9 | 14 | 19.5 |
| Retests - Rolled 0.0095 to 0.009 | | | | |
| 750 | 142.7 | 119.3 | 19 | 20.6 |
| 750 | 143.3 | 119.5 | 20 | 20.9 |
| 800 | 157.3 | 132.6 | 17 | 20.0 |
| 800 | 157.8 | 134.2 | 16 | 20.4 |

TM04 Alloys

Next, strips were formed from TM04 rated copper-nickel-tin alloys containing 15 wt % nickel, 8 wt % tin, and balance copper, and having a yield strength of 115 to 135 ksi. The alloys were formed into strips having an initial thickness of 0.010 inches that were then cold worked to obtain a % CW of 10%, i.e. final thickness 0.009 inches. The strips were cold worked using a rolling assembly traveling at a rate of between 6 and 14 feet per minute (fpm). The strips then underwent a thermal stress relief treatment at temperatures of 750° F. or 800° F.

Various properties were measured, including the formability ratio in both the longitudinal direction)(L90° and the transverse direction)(T90°. The results are shown in Table 2 below.

TABLE 2

| Temp | FPM | T | Y | E | M | L90° | T90° |
|---|---|---|---|---|---|---|---|
| 750 | 6 | 144.0 | 118.4 | 19 | 20.9 | .010R | .008R |
| 750 | 6 | 141.2 | 117.1 | 21 | 21.2 | 1.1 | 0.9 |
| 800 | 6 | 157.3 | 132.8 | 17 | 20.5 | .023R | .019R |
| 800 | 6 | 160.2 | 135.9 | 18 | 21.6 | 2.6 | 2.1 |
| 800 | 8 | 155.7 | 131.9 | 17 | 21.0 | .023R | .017R |
| 800 | 8 | 153.5 | 128.6 | 17 | 21.3 | 2.6 | 1.9 |
| 800 | 10 | 150.3 | 126.1 | 16 | 20.3 | .019R | .017R |
| 800 | 10 | 149.0 | 123.3 | 17 | 21.6 | 2.1 | 1.9 |
| 800 | 12 | 143.1 | 118.5 | 18 | 21.7 | .015R | .011R |
| 800 | 12 | 142.4 | 118.2 | 17 | 20.3 | 1.7 | 1.2 |
| 800 | 14 | 140.1 | 115.6 | 20 | 21.4 | .011R | .008R |
| 800 | 14 | 140.4 | 115.7 | 21 | 20.8 | 1.2 | .9 |

TM06 Alloys

Next, strips were formed from TM06 rated copper-nickel-tin alloys containing 15 wt % nickel, 8 wt % tin, and balance copper, and having a yield strength of 135 to 155 ksi. The alloys were formed into strips having an initial thickness of 0.010 inches that were then cold worked to obtain a % CW of 15%, i.e. final thickness 0.0085 inches. The strips were cold worked using a rolling assembly traveling at a rate of between 6 and 10 feet per minute (fpm). The strips then underwent a thermal stress relief treatment at temperatures of 800° F. or 850° F.

Various properties were measured, including the formability ratio in both the longitudinal direction)(L90° and the transverse direction)(T90°. The results are shown in Table 3A below.

Table 3B presents similar information to that of Table 3A, except that the strips were cold worked to obtain a % CW of 20%, i.e. final thickness 0.008 inches.

TABLE 3A

| Temp | FPM | T | Y | E | M | L90° | T90° |
|---|---|---|---|---|---|---|---|
| 800 | 6 | 161.8 | 141.8 | 15 | 19.7 | .028R | .023R |
| 800 | 6 | 161.9 | 141.7 | 14 | 19.9 | 3.3 | 2.7 |
| 850 | 6 | 169.6 | 157.6 | 12 | 19.6 | .037R | .042R |
| 850 | 6 | 168.5 | 154.9 | 11 | 19.6 | 4.4 | 4.9 |
| 850 | 8 | 168.8 | 155.3 | 11 | 20.2 | .031R | .031R |
| 850 | 8 | 169.3 | 156.3 | 10 | 20.1 | 3.6 | 3.6 |
| 850 | 10 | 165.0 | 149.0 | 12 | 20.2 | .029R | .031R |
| 850 | 10 | 166.8 | 152.0 | 12 | 19.5 | 3.4 | 3.6 |

TABLE 3B

| Temp | FPM | T | Y | E | M | L90° | T90° |
|---|---|---|---|---|---|---|---|
| 750 | 6 | 156.7 | 141.6 | 14 | 19.6 | .017R | .010R |
| 750 | 6 | 155.5 | 139.9 | 15 | 21.3 | 2.1 | 1.3 |
| 800 | 6 | 168.0 | 152.5 | 10 | 21.8 | .026R | .020R |
| 800 | 6 | 170.4 | 155.5 | 10 | 21.3 | 3.3 | 2.5 |
| 800 | 8 | 163.0 | 146.9 | 10 | 21.5 | .026R | .015R |
| 800 | 8 | 163.1 | 146.9 | 10 | 21.2 | 3.3 | 1.9 |
| 800 | 10 | 166.5 | 149.1 | 14 | 21.5 | .023R | .019R |
| 800 | 10 | 165.7 | 149.7 | 13 | 20.8 | 2.9 | 2.4 |

Heat Treated Alloys

Strips were formed from TM04 or TM06 rated copper-nickel-tin alloys containing 15 wt % nickel, 8 wt % tin, and balance copper. The alloys were formed into strips having an initial thickness of 0.010 inches that were then cold worked to obtain a % CW of 55%, i.e. final thickness 0.0045 inches.

The strips were then subjected to a heat treatment of 575° F., 600° F., or 625° F. for a period of 2, 3, 4, 6, or 8 hours, as indicated in the Time/Temp column.

Various properties were then measured, including the formability ratio in both the longitudinal direction)(L90° and the transverse direction)(T90°. The results are shown in Table 4 below.

TABLE 4

| Time & Temp | T | Y | E | M | L90° | T90° |
|---|---|---|---|---|---|---|
| | | | TM04 | | | |
| 3/575 | 119.4 | 106.5 | 18 | 19.44 | .008R | .007R |
| 3/575 | 119.4 | 106.4 | 17 | 19.79 | 1.78 | 1.56 |
| 4/575 | 121.4 | 108.2 | 16 | 19.6 | .008R | .007R |
| 4/575 | 121.3 | 108.3 | 15 | 19.5 | 1.78 | 1.56 |
| 2/600 | 121.2 | 109.0 | 16 | 19.93 | .008R | .007R |
| 2/600 | 121.9 | 109.6 | 18 | 20.2 | 1.78 | 1.56 |
| | | | TM06 | | | |
| 6/600 | 133.9 | 120.2 | 15 | 20.8 | .010R | .008R |
| 6/600 | 132.0 | 118.3 | 16 | 19.66 | 2.22 | 1.78 |
| 8/600 | 136.1 | 123.4 | 16 | 14.52 | .011R | .010R |
| 8/600 | 137.3 | 124.1 | 15 | 14.77 | 2.44 | 2.22 |
| 4/625 | 137.0 | 122.4 | 16 | 19.12 | .013R | .011R |
| 4/625 | 137.1 | 122.4 | 17 | 19.96 | 2.89 | 2.44 |

The alloys of the present disclosure are high-performance, heat treatable spinodal copper-nickel-tin alloys that are designed to provide optimal formability and strength characteristics in conductive spring applications such as electronic connectors, switches, sensors, electromagnetic shielding gaskets, and voice coil motor contacts. In one embodiment, the alloys can be provided in a pre-heat treated (mill hardened) form. In another embodiment, the alloys can be provided in a heat treatable (age hardenable) form. Additionally, the disclosed alloys do not contain beryllium and thus can be utilized in applications which beryllium is not desirable.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A process for improving the formability of a wrought copper-nickel-tin alloy having a 0.2% offset yield strength that is at least 115 ksi, comprising:

performing a first mechanical cold working step on a copper-nickel-tin alloy to a percentage of cold working (% CW) of about 5% to about 15%; and relieving stress in the alloy through a heat treatment step.

2. The process of claim 1, wherein the heat treatment for relieving stress in the alloy is performed at a temperature in the range of 700° F. to 950° F. for a period of about 3 minutes to about 12 minutes.

3. The process of claim 1, wherein the heat treatment for relieving stress in the alloy is performed at a temperature in the range of 775° F. to 950° F. for a period of about 3 minutes to about 12 minutes.

4. The process of claim 1, wherein after the heat treatment for relieving stress, the alloy has a yield strength of at least 130 ksi.

5. The process of claim 1, wherein after the heat treatment for relieving stress, the alloy has a formability ratio that is below 2 in the transverse direction.

6. The process of claim 1, wherein after the heat treatment for relieving stress, the alloy has a formability ratio that is below 2.5 in the longitudinal direction.

7. The process of claim 1, wherein after the heat treatment for relieving stress, the alloy has a yield strength of at least 130 ksi, a formability ratio that is below 2 in the transverse direction, and a formability ratio that is below 2.5 in the longitudinal direction.

8. The process of claim 1, wherein after the heat treatment for relieving stress, the alloy has a formability ratio that is below 1.5 in the transverse direction.

9. The process of claim 1, wherein after the heat treatment for relieving stress, the alloy has a formability ratio that is below 2 in the longitudinal direction.

10. The process of claim 1, wherein after heat treatment, the alloy has a formability ratio that is below 1.5 in the transverse direction, and a formability ratio that is below 2 in the longitudinal direction.

11. The process of claim 1, wherein after heat treatment, the alloy has a yield strength of at least 135 ksi.

12. The process of claim 1, further comprising:

heat treating the copper-nickel-tin alloy after the first cold working step; and performing a second cold working step on the copper-nickel-tin alloy to a % CW of about 4% to about 12% prior to relieving stress in the alloy through heat treatment.

13. The process of claim 12, wherein the heat treating after the first cold working is performed by exposing the alloy to a temperature from about 450° F. to about 550° F. for a period of from about 3 hours to about 5 hours.

14. The process of claim 12, wherein the heat treatment for relieving stress in the alloy is performed at a temperature in the range of 700° F. to 850° F. for a period of about 3 minutes to about 12 minutes.

15. The process of claim 12, wherein after the heat treatment for relieving stress, the alloy has a formability ratio that is below 1 in the transverse direction.

16. The process of claim 12, wherein after the heat treatment for relieving stress, the alloy has a formability ratio that is below 1 in the longitudinal direction.

17. The process of claim 12, wherein after the heat treatment for relieving stress, the alloy has a yield strength of at least 115 ksi, a formability ratio that is below 1 in the transverse direction, and a formability ratio that is below 1 in the longitudinal direction.

18. The process of claim 12, wherein the copper-nickel-tin alloy includes from about 14.5 wt % to about 15.5 wt % nickel, and from about 7.5 wt % to about 8.5 wt % tin, with the remaining balance being copper.

19. The process of claim 12, wherein the alloy is a spinodally-hardened material.

20. A process for improving the formability of a wrought copper-nickel-tin alloy having a 0.2% offset yield strength that is at least 115 ksi, comprising:

performing a first mechanical cold working step on a copper-nickel-tin alloy to a % CW of about 5% to about 15%;

heat treating the copper-nickel-tin alloy after the first cold working by exposing the alloy to a temperature from about 450° F. to about 550° F.;

performing a second mechanical cold working step on the copper-nickel-tin alloy to a % CW of about 4% to about 12%; and relieving stress in the alloy through heat treatment by exposing the alloy to a temperature from about 700° F. to about 850° F.

* * * * *